US010988330B2

(12) United States Patent
Hayes et al.

(10) Patent No.: US 10,988,330 B2
(45) Date of Patent: Apr. 27, 2021

(54) MEDIA SIZE DETECTOR

(71) Applicant: Hewlett-Packard Development Company, L.P., Spring, TX (US)

(72) Inventors: Alan Hayes, Vancouver, WA (US); Mark Olson, Vancouver, WA (US); Alexander M Nameroff, Vancouver, WA (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 70 days.

(21) Appl. No.: 16/330,831

(22) PCT Filed: Sep. 8, 2016

(86) PCT No.: PCT/US2016/050785
§ 371 (c)(1),
(2) Date: Mar. 6, 2019

(87) PCT Pub. No.: WO2018/048410
PCT Pub. Date: Mar. 15, 2018

(65) Prior Publication Data

US 2019/0193962 A1 Jun. 27, 2019

(51) Int. Cl.
*B65H 1/04* (2006.01)
*G03G 15/00* (2006.01)

(52) U.S. Cl.
CPC ..... *B65H 1/04* (2013.01); *B65H 2405/1122* (2013.01); *B65H 2511/11* (2013.01);
(Continued)

(58) Field of Classification Search
CPC ..... B65H 31/20; B65H 2405/1122; B65H 2405/1142; B65H 2405/11425;
(Continued)

(56) References Cited

U.S. PATENT DOCUMENTS 5,436,418 A 7/1995 Tamehira
5,931,456 A 8/1999 Laidlaw
(Continued)

FOREIGN PATENT DOCUMENTS

CN 1117009 A 2/1996
CN 1495409 A 5/2004
(Continued)

OTHER PUBLICATIONS

Dell—Load Tray or Paper Size Mismatch Error Codes 024-910, 024-911, 024-912, 024-913, 024-914, 024-915, 024-965, 024-966, 024-967, 024-968, 024-969, 024-970 on the 5130cdn Dell Laser Printer, Aug. 17, 2015, 9 pages.

*Primary Examiner* — Jeremy R Severson
(74) *Attorney, Agent, or Firm* — Brooks Cameron & Huebsch PLLP

(57) ABSTRACT

In one example, a media size detector includes a button coupled to a spring of a housing to interact with a media size adjuster of a media tray, a first side of a lever to receive pressure from the spring when the button is depressed by the media size adjuster, and a second side of the lever to apply pressure to activate or deactivate a switch coupled to a printed circuit assembly when the first side of the lever receives pressure from the spring.

15 Claims, 5 Drawing Sheets

(52) U.S. Cl.
CPC ..... *B65H 2511/12* (2013.01); *G03G 15/6502* (2013.01); *G03G 2215/00734* (2013.01)

(58) Field of Classification Search
CPC ..... B65H 2511/11; B65H 2511/12; G03G 2215/00734
See application file for complete search history.

(56) References Cited

U.S. PATENT DOCUMENTS

| | | | | |
|---|---|---|---|---|
| 6,264,195 | B1 | 7/2001 | Hoberock et al. | |
| 6,267,522 | B1 | 7/2001 | Slippy et al. | |
| 6,665,080 | B1 | 12/2003 | Schaefer et al. | |
| 6,701,837 | B2 * | 3/2004 | Ohba | B65H 23/0216 101/225 |
| 7,516,955 | B2 * | 4/2009 | Yamagishi | B65H 1/266 271/171 |
| 7,694,960 | B2 * | 4/2010 | Sing | B65H 1/266 271/171 |
| 8,360,419 | B2 * | 1/2013 | Hiura | B65H 1/266 271/171 |
| 8,584,371 | B2 * | 11/2013 | Marumoto | B65H 1/266 33/555 |
| 9,227,808 | B2 | 1/2016 | Chiba | |
| 9,637,329 | B2 * | 5/2017 | Hayayumi | B65H 1/04 |
| 9,812,267 | B2 * | 11/2017 | Hozumi | H01H 9/063 |
| 10,703,593 | B2 * | 7/2020 | Maeda | B65H 1/266 |
| 2009/0051101 | A1 * | 2/2009 | Yamagishi | B65H 1/04 271/171 |

FOREIGN PATENT DOCUMENTS

| | | | |
|---|---|---|---|
| CN | 101372289 | A | 2/2009 |
| CN | 102464214 | A | 5/2012 |
| CN | 103204004 | A | 7/2013 |
| CN | 104635447 | A | 5/2015 |
| CN | 105121315 | A | 12/2015 |
| JP | 200231832 | A | 12/2002 |
| JP | 2006137597 | A | 6/2006 |
| JP | 2012116658 | A | 6/2012 |

* cited by examiner

MEDIA SIZE DETECTOR

BACKGROUND

Printing devices can utilize a number of different methods for generating images on media, The media can include print media such as paper, plastic, etc. In some examples, the printing devices can utilize a plurality of different size media. In some examples, the printing devices can include media trays to store and provide media to a print zone, In some examples, the media trays can include a media size adjuster that can be utilized to adjust the media tray for a particular size of media, In some examples, the size of the media can have different settings and/or configurations for printing.

DETAILED DESCRIPTION

Figure 1:
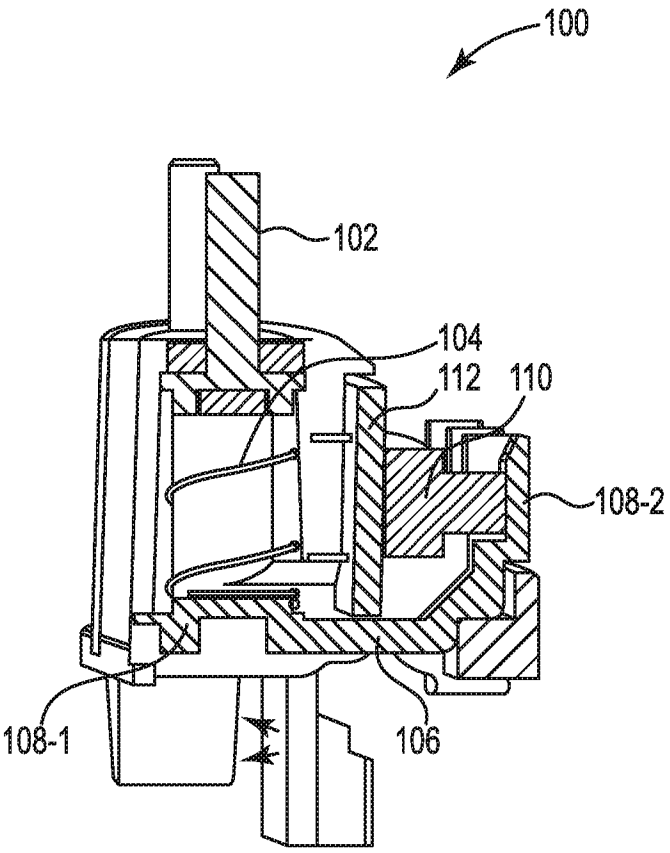
FIG. 1 illustrates an example device for a media size detector consistent with the present disclosure.

A number of systems and devices for a media size detector are described herein. In one example, a media size detector includes a button coupled to a spring of a housing to interact with a media size adjuster of a media tray, a first side of a lever to receive pressure from the spring when the button is depressed by the media size adjuster, and a second side of the lever to apply pressure to activate or deactivate a switch coupled to a printed circuit assembly when the first side of the lever receives pressure from the spring. The media size detector described herein can be relatively inexpensive compared to previous media size detectors and can utilize non-metal contacts to determine a media size within a media tray. In some examples, settings of a printing device can be altered based on the determined media size.

In some examples, the media size detector can be coupled to a rail or wall of a media tray utilizing a media size adjuster. The media size detector can be positioned in a fixed location and receive a size detect barrel coupled to the media tray such that the size detect barrel interacts with the media size adjuster when the media tray is in a closed position. In some examples, a media size detector can interact with the size detect barrel that is coupled to a media size adjuster of the media tray. For example, when the media size adjuster is adjusted, the size detect barrel can rotate and depress a particular combination of buttons on the media size detector.

In some examples, the particular combination of buttons can correspond to a particular media size. In some examples, the buttons of the media size detector can utilize a lever to depress a corresponding switch coupled to a printed circuit assembly. In some examples, the combination of buttons can alter a voltage across the printed circuit assembly. In these examples, the particular voltage can correspond to the particular media size. The printed circuit assembly can then send the determined voltage altered by the combination of buttons to a computing device of the printing device.

The figures herein follow a numbering convention in which the first digit corresponds to the drawing figure number and the remaining digits identify an element or component in the drawing. Elements shown in the various figures herein may be capable of being added, exchanged, and/or eliminated so as to provide a number of additional examples of the present disclosure. In addition, the proportion and the relative scale of the elements provided in the figures are intended to illustrate the examples of the present disclosure, and should not be taken in a limiting sense.

FIG. 1 illustrates an example device 100 for a media size detector consistent with the present disclosure. In some examples, the device 100 can be utilized to determine a size of media within a media tray. In some examples, the device 100 can determine the size of the media within the media tray based on an orientation of a size detect barrel coupled to a media size adjuster within the media tray. The media size adjuster can be utilized to adjust barriers within the media tray to fit a plurality of different media sizes.

In some examples, the device 100 can include a button 102 that can interact with a size detect barrel coupled to the media size adjuster. In some examples, the button 102 can include a first portion that extrudes from a housing 114 and a second portion that includes a plunger to interact with a spring 104 within the housing 114. In some examples, the button 102 can be depressed and compress the spring 104 within the housing 114. In some examples, the button 102 can be depressed by a size detect barrel coupled to the media size adjuster within the media tray.

In some examples, the button 102 can be depressed and compress the spring 104 to apply pressure to a lever 106. In some examples, the lever 106 can include a first side 108-1 and a second side 108-2. The first side 108-1 can be on a first side of a fulcrum (e.g., pivot point) of the lever 106 and the second side 108-2 can be on a second side of the fulcrum. As used herein, a fulcrum is a point on which a lever rests and on which the lever pivots. In some examples, the spring 104 can apply pressure on the first side 108-1 of the lever 106 when the button 102 is depressed. The pressure applied to the first side 108-1 of the can be transferred to the second side 108-2 of the lever 106. In some examples, the second side 108-2 of the lever 106 can interact with a switch 110 coupled to a printed circuit assembly 112. For example, the second side 108-2 of the lever 106 can depress the switch 110 when pressure is applied to the button 102 by a size detect barrel.

In some examples, the switch 110 can be a micro switch coupled to a circuit of the printed circuit assembly 112. As used herein, the switch 110 includes a device that can activate and/or deactivate by a physical force (e.g., depressed by a side of a lever 106, etc.). The switch 110 can be activated to connect a circuit or disconnect a circuit. In some examples, the voltage can be applied to the circuit of the printed circuit assembly 112 by a controller. As used herein, a printed circuit assembly 112 can include a device to mechanically support and electrically connect components utilizing conductive tracks, pads, and/or other features etched from conductive sheets onto a non-conductive substrate.

In some examples, a voltage can be applied to the circuit of the printed circuit assembly 112 can be affected by the switch 110. For example, when the switch 110 is activated a resistance can be added to the circuit of the printed circuit assembly 112 and lower a detected voltage applied by the controller. In this example, the controller can determine the affected voltage to determine a quantity of buttons and/or combination of buttons depressed by the size detect barrel.

In some examples, the controller can determine a size of media within the media tray based on the affected voltage across the circuit of the printed circuit assembly 112.

The device 100 can include a housing 114 that is positioned on a first side (e.g., left side as illustrated in FIG. 1) of the printed circuit assembly 112. As described herein, the housing 114 can include a button 102 that extrudes from the housing 114 to interact with a size detect barrel on the first side of the printed circuit assembly 112. The device 100 can utilize the level 106 to interact with the switch 110 coupled to the printed circuit assembly 112 on a second side (e.g., right side as illustrated in FIG. 1).

In some examples, the device button 102 can be depressed by a size detect barrel in a first direction (e.g., downward direction as illustrated in FIG. 1). As described herein, depressing the button 102 can apply pressure on the spring 104 and the spring 104 can apply pressure on a first side 108-1 of the lever 106. The pressure applied on the first side 108-1 of the lever 106 can be transferred to the second side 108-2 of the lever 106 to interact with the switch 110 in a second direction (e.g., left direction as illustrated in FIG. 1). In some examples, the second direction can be perpendicular to the first direction or substantially perpendicular. As used herein, substantially perpendicular can be more perpendicular than parallel. In some examples, a plunger coupled to the button 102, the spring 104, and/or the first side 108-1 of the lever 106 can be positioned within the housing 114. In some examples, a fulcrum of the lever 106, a second side 108-2 of the lever 106, the switch 110, and/or the printed circuit assembly 112 can be positioned outside the housing 114.

The device 100 can be utilized to determine a size of media within a media tray of a printing device. In some examples, the device 100 can interact with a size detect barrel coupled to a size adjuster within the media tray. As described herein, the size detect barrel can depress the button 102 and/or other buttons of the device 100 based on a selected size of the size adjuster within the media tray. In some examples, the combination of depressed buttons can correspond to a particular media size and/or a setting of the size adjuster within the media tray.

Figure 2:
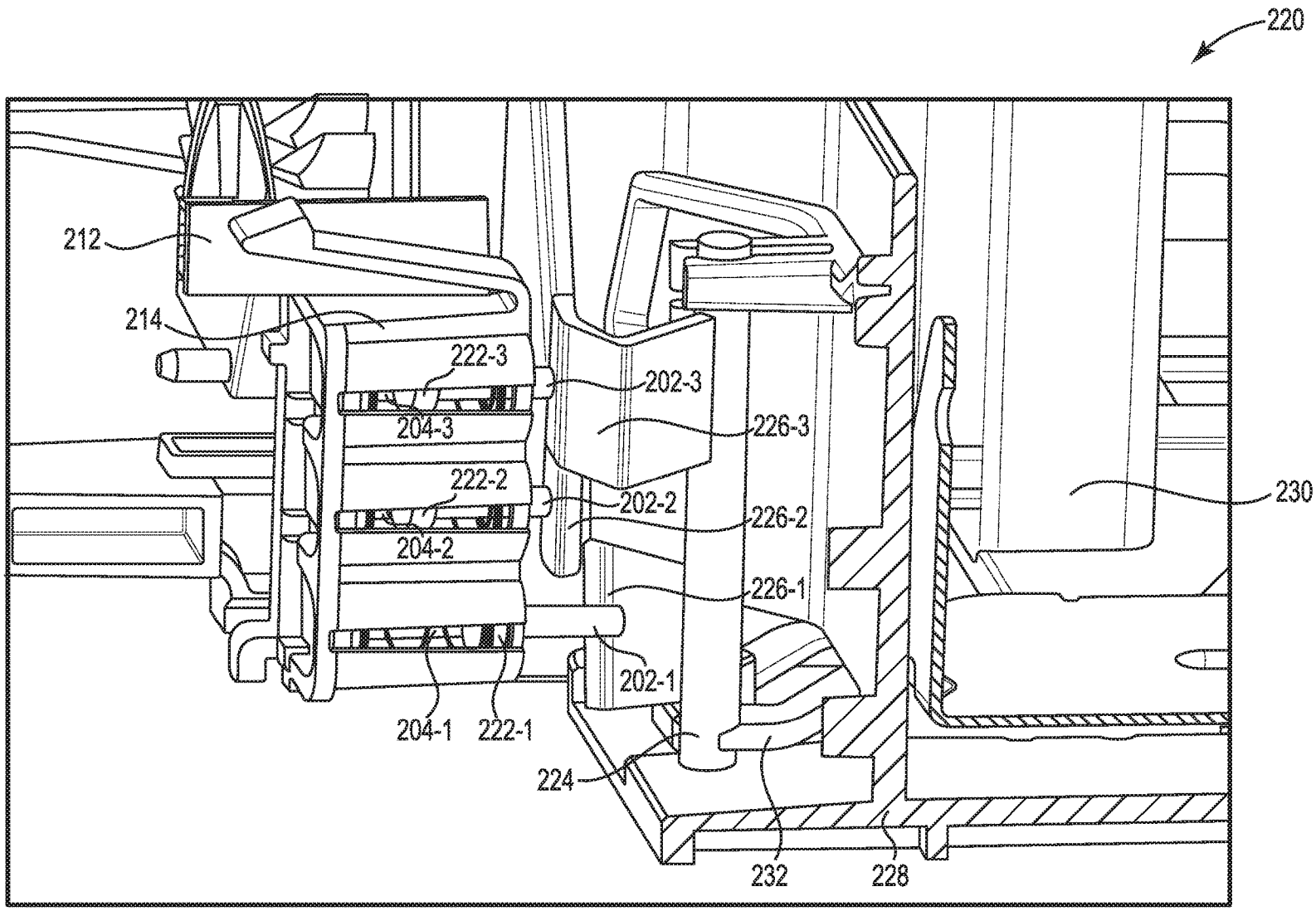
FIG. 2 illustrates an example system for a media size detector consistent with the present disclosure.

FIG. 2 illustrates an example system 220 for a media size detector consistent with the present disclosure. The system 220 can include a device 200 that can include similar elements as device 100 as referenced in FIG. 1. For example, the device 200 can include a plurality of buttons 202-1, 202-2, 202-3 that can interact with a size detect barrel 224.

As described herein, the plurality of buttons 202-1, 202-2, 202-3 can interact with barrel surfaces 226-1, 226-2, 226-3 of the size detect barrel 224. In some examples, the position of the barrel surfaces 226-1, 226-2, 226-3 can be altered or rotated based on a position of a media size adjuster 230 within a media tray 228. As used herein, a media size adjuster 230 is a physical barrier within a media tray 228 that can be adjusted to allow a plurality of different media sizes to fit within the physical barrier.

The system 220 can be utilized to determine a size of media within the media tray 228 based on a position of the media size adjuster 230. For example, the size detect barrel 224 can be coupled to the media size adjuster 230 with a slotted connector 232. The slotted connector 232 can be directly coupled to the media size adjuster 230 and directly coupled to the size detect barrel 224 to pivot or rotate the size detect barrel 224, which can move the barrel surfaces 226-1, 226-2, 226-3 into a particular orientation to depress a particular combination of the plurality of buttons 202-1, 202-2, 202-3. As described herein, the device 200 can determine a position of the media size adjuster 230 and/or the size of the media within the media tray 228 based on the combination of buttons 202-1, 202-2, 202-3 depressed by the barrel surfaces 226-1, 226-2, 226-3 of the size detect barrel 224.

As described herein, the plurality of barrel surfaces 226-1, 226-2, 226-3 of the size detect barrel 224 can depress a combination of the plurality of buttons 202-1, 202-2, 202-3 based on a position of the size detect barrel 224. For example, the size detect barrel 224 can be positioned such that barrel surface 226-2 and barrel surface 226-3 depress corresponding buttons 202-2, 202-3. In this example, the barrel surface 226-1 can be positioned to not depress the corresponding button 202-1. In this example, the combination of the plurality of buttons 202-1, 202-2, 202-3 can be that button 202-1 is not depressed, button 202-2 is depressed, and button 202-3 is depressed. In this example, a switch corresponding to button 202-1 is not depressed, a switch corresponding to button 202-2 is depressed, and a switch corresponding to button 202-3 is depressed. In this example, the combination of depressed switches and non-depressed switches can be utilized to generate or alter a voltage of a circuit coupled to the switches of a printed circuit assembly 212 that can correspond to a particular setting of the media size adjuster 230 and/or a particular size of media within the media tray 228.

As described herein, the plurality of buttons 202-1, 202-2, 202-3 can be coupled to a corresponding plunger 222-1, 222-2, 222-3 within the housing 214. As used herein, a plunger 222-1, 222-2, 222-3 can be a relatively wider portion of the buttons 202-1, 202-2, 202-3 that is contained within a corresponding channel of the housing 214. In some examples, the plunger 222-1, 222-2, 222-3 can extend across a corresponding channel of the housing 214 such that the spring 204-1, 204-2, 204-3 is not capable of bypassing the plunger 222-1, 222-2, 222-3. For example, when the channel is circular with a particular diameter, the plunger 222-1, 222-2, 222-3 can also be circular with a slightly smaller diameter to be allowed to depress the spring 204-1, 204-2, 204-3, but not allow the spring 204-1, 204-2, 204-3 to bypass the plunger 222-1, 222-2, 222-3. The plunger 222-1, 222-2, 222-3 of the plurality of buttons 202-1, 202-2, 202-3 can be coupled to a corresponding spring 204-1, 204-2, 204-3. As described herein, the plunger 222-1, 222-2, 222-3 can be utilized to depress the corresponding spring 204-1, 204-2, 204-3 and apply pressure to a corresponding lever to apply pressure to a corresponding switch.

In some examples, the device 200 can be coupled to a wall (e.g., rear wall, wall behind the media tray 228, etc.) of a chassis for coupling the media tray 228 to a printing device. In some examples, the device 200 can be coupled to a fixed position that does not move with the media tray 228 when the media tray 228 is removed from the printing device to adjust the media size adjuster 230 and/or add media to the media tray 228. In some examples, the size detect barrel 224 can be coupled to the media tray 228 and move with the media tray 228 when the media tray 228 is removed from the printing device.

The system 220 can be utilized to determine a size of media within a media tray 228 of a printing device. In some examples, the device 200 can interact with a size detect barrel 224 coupled to a size adjuster 230 within the media tray 228. As described herein, the size detect barrel 224 can depress a combination of buttons 202-1, 202-2, 202-3 of the device 200 based on a selected size of the media size adjuster 230 within the media tray 228. In some examples, the combination of depressed buttons can correspond to a particular media size and/or a setting of the size adjuster 230 within the media tray 228.

Figure 3:
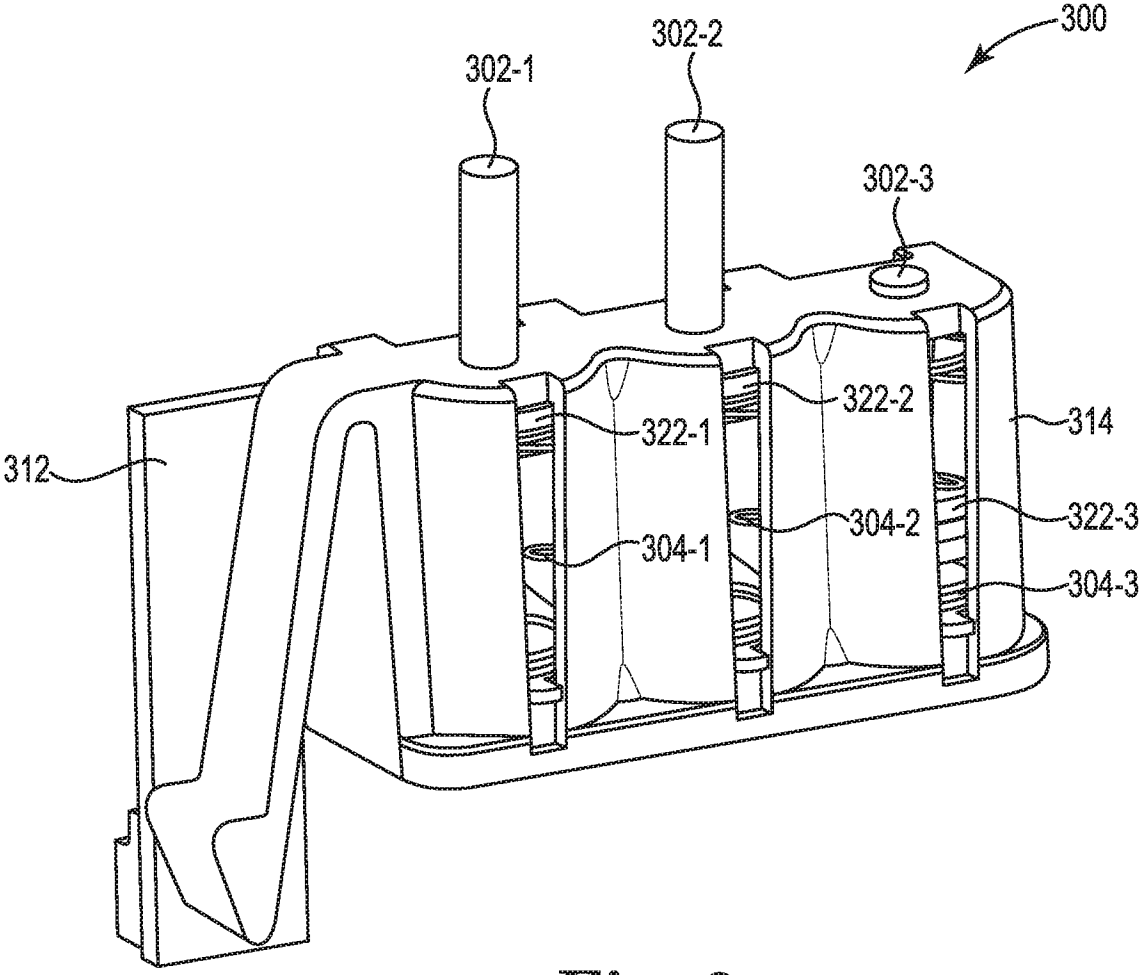
FIG. 3 illustrates an example device for a media size detector consistent with the present disclosure.

FIG. 3 illustrates an example device 300 for a media size detector consistent with the present disclosure. The device 300 can include similar elements as device 100 as referenced in FIG. 1 and/or device 200 as referenced in FIG. 2. FIG. 3 can illustrate a first side of the device 300. As described herein, the first side of the device 300 can include a housing 314 that can include a plurality of buttons 302-1, 302-2, 302-3 that extend outside the housing 314. As described herein, the plurality of buttons 302-1, 302-2, 302-3 can extend outside the housing 314 to interact with a size detect barrel.

The plurality of buttons 302-1, 302-2, 302-3 can be coupled to a corresponding plurality of plungers 322-1, 322-2, 322-3. The plunger 322-1, 322-2, 322-3 of the plurality of buttons 302-1, 302-2, 302-3 can be coupled to a corresponding spring 304-1, 304-2, 304-3. As described herein, the plunger 322-1, 322-2, 322-3 can be utilized to depress the corresponding spring 304-1, 304-2, 304-3 and apply pressure to a corresponding lever to apply pressure to a corresponding switch coupled to a second side of the printed circuit assembly 312. As described herein, a portion of the plurality of buttons 302-1, 302-2, 302-3 can be depressed and a portion of the plurality of buttons 302-1, 302-2, 302-3 may not be depressed to generate a particular combination of the plurality of buttons 302-1, 302-2, 302-3 that are depressed.

As described herein, the combination of depressed plurality of buttons 302-1, 302-2, 302-3 can be utilized to determine a media size within a media tray and/or a setting of a media adjuster within the media tray, For example, FIG. 3 illustrates that device 300 has button 302-3 depressed. In this example, the device 300 has button 302-1 and button 302-2 not depressed. In this example, the combination of depressed plurality of buttons 302-1, 302-2, 302-3 is two buttons 302-1, 302-2 not depressed and one button 302-3 depressed. As described herein, this combination of depressed plurality of buttons 302-1, 302-2, 302-3 can correspond to a particular setting of a media size adjuster and/or a particular size of media within a media tray.

As described herein, a plurality of switches that correspond to the plurality of buttons 302-1, 302-2, 302-3 can affect a voltage or current on the circuit based on a quantity or combination of activated switches corresponding to depressed buttons and/or deactivated switches corresponding to non-depressed buttons. For example, the combination of depressed plurality of buttons 302-1, 302-2, 302-3 can correspond to a particular voltage that is determined by a controller coupled to the printed circuit assembly 312. In some examples, the printed circuit assembly 312 can send the determined voltage and/or a determined signal to a computing device within the printing device to notify the printing device of a particular setting of a media size adjuster and/or a particular size of media within a media tray.

The device 300 can be utilized to determine a size of media within a media tray of a printing device. In some examples, the device 300 can interact with a size detect barrel coupled to a size adjuster within the media tray. As described herein, the size detect barrel can depress a combination of buttons 302-1, 302-2, 302-3 based on a selected size of the media size adjuster within the media tray. In some examples, the combination of depressed buttons can correspond to a particular media size and/or a setting of the size adjuster within the media tray.

Figure 4:
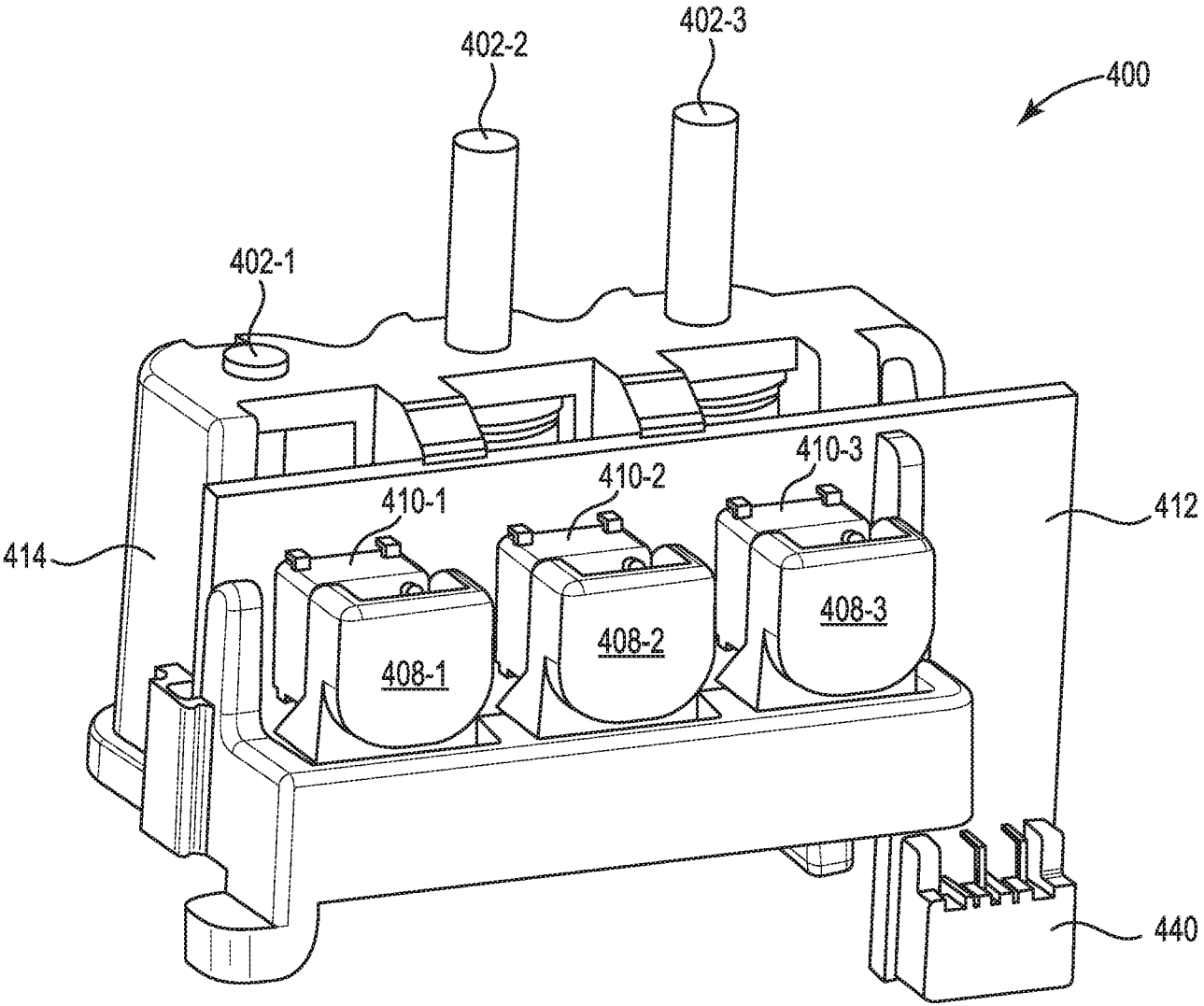
FIG. 4 illustrates an example device for a media size detector consistent with the present disclosure.

FIG. 4 illustrates an example device 400 for a media size detector consistent with the present disclosure. The device 400 can include similar elements as device 100 as referenced in FIG. 1, device 200 as referenced in FIG. 2, and/or device 300 as referenced in FIG. 3, FIG. 4 can illustrate a second side of the device 400, As described herein, the second side of the device 400 can include a housing 414 that can include a plurality of buttons 402-1, 402-2, 402-3 that extend outside the housing 414, As described herein, the plurality of buttons 402-1, 402-2, 402-3 can extend outside the housing 414 to interact with a size detect barrel.

As described herein, a combination of depressed plurality of buttons 402-1, 402-2, 402-3 can be utilized to determine a media size within a media tray and/or a setting of a media adjuster within the media tray. For example, FIG. 4 illustrates that device 400 has button 402-1 depressed. In this example, the device 400 has button 402-1 and button 402-3 not depressed. In this example, the combination of depressed plurality of buttons 402-1, 402-2, 402-3 is two buttons 402-2, 402-3 not depressed and one button 402-1 depressed. As described herein, this combination of depressed plurality of buttons 402-1, 402-2, 402-3 can correspond to a particular setting of a media size adjuster and/or a particular size of media within a media tray.

As described herein, the housing 414 for the plurality of buttons 402-1, 402-2, 402-3 can be on a first side of the printed circuit assembly 412 and a plurality of switches 410-1, 410-2, 410-3 can be coupled to the second side of the printed circuit assembly 412. In some examples, the plurality of buttons 402-1, 402-2, 402-3 can utilize a lever as described herein to apply pressure to a first side of the lever and transfer pressure to a second side 408-1, 408-2, 408-3 of the lever to apply pressure on the plurality of switches 410-1, 410-2, 410-3. As described herein, the second side 408-1, 408-2, 408-3 of the lever can be utilized to activate and/or deactivate the plurality of switches 410-1, 410-2, 410-3.

The device 400 can include a controller 440. In some examples, the controller 440 can be coupled to the plurality of switches 410-1, 410-2, 410-3. In some examples, the controller 440 can be coupled to the plurality of switches 410-1, 410-2, 410-3 by a circuit. The controller 440 can apply a voltage or current on the circuit. As described herein, the plurality of switches 410-1, 410-2, 410-3 can affect the voltage or current on the circuit based on a quantity or combination of activated switches (e.g., switch 410-1, etc.) and/or deactivated switches (e.g., switch 410-2, switch 410-2, etc.). In some examples, a depressed button 402-1, 402-2, 402-3 or a depressed switch 410-1, 410-2, 410-3 can correspond to an activated switch. Conversely, a non-depressed button 402-1, 402-2, 402-3 or a non-depressed switch 410-1, 410-2, 410-3 can correspond to a deactivated switch.

In some examples, an activated switch can increase a resistance within the circuit and alter the voltage or current of the circuit. In some examples, the controller 440 can be utilized to determine the voltage of the circuit and determine which of the plurality of switches 410-1, 410-2, 410-3 are activated and which of the plurality of switches 410-1, 410-2, 410-3 are deactivated based on the determined voltage. For example, the controller 440 can determine a first voltage when switch 410-1 is activated and switches 410-2, 410-3 are deactivated. In this example, the controller 440 can determine a second voltage that is different than the first voltage when switches 402-2, 402-3 are activated and switch 410-1 is deactivated.

In some examples, the determined voltage can be compared to a plurality of voltage ranges. The voltage ranges can correspond to particular settings of the media size adjuster and/or a media size within a media tray. In some examples, the printed circuit assembly 412 can send the determined voltage and/or a determined signal to a computing device within the printing device to notify the printing device of a particular setting of a media size adjuster and/or a particular size of media within a media tray. In some examples, the printed circuit assembly 412 can generate a signal or voltage based on the combination of activated and/or deactivated switches 410-1, 410-2, 410-3. For example, a signal from the printed circuit assembly 412 can be sent to a computing device of a printing device based on whether switch or combination of switches are activated or deactivated.

The device 400 can be utilized to determine a size of media within a media tray of a printing device. In some examples, the device 400 can interact with a size detect barrel coupled to a size adjuster within the media tray. As described herein, the size detect barrel can depress a combination of buttons 402-1, 402-2, 402-3 based on a selected size of the media size adjuster within the media tray. In some examples, the combination of depressed buttons can correspond to a particular media size and/or a setting of the size adjuster within the media tray.

Figure 5:
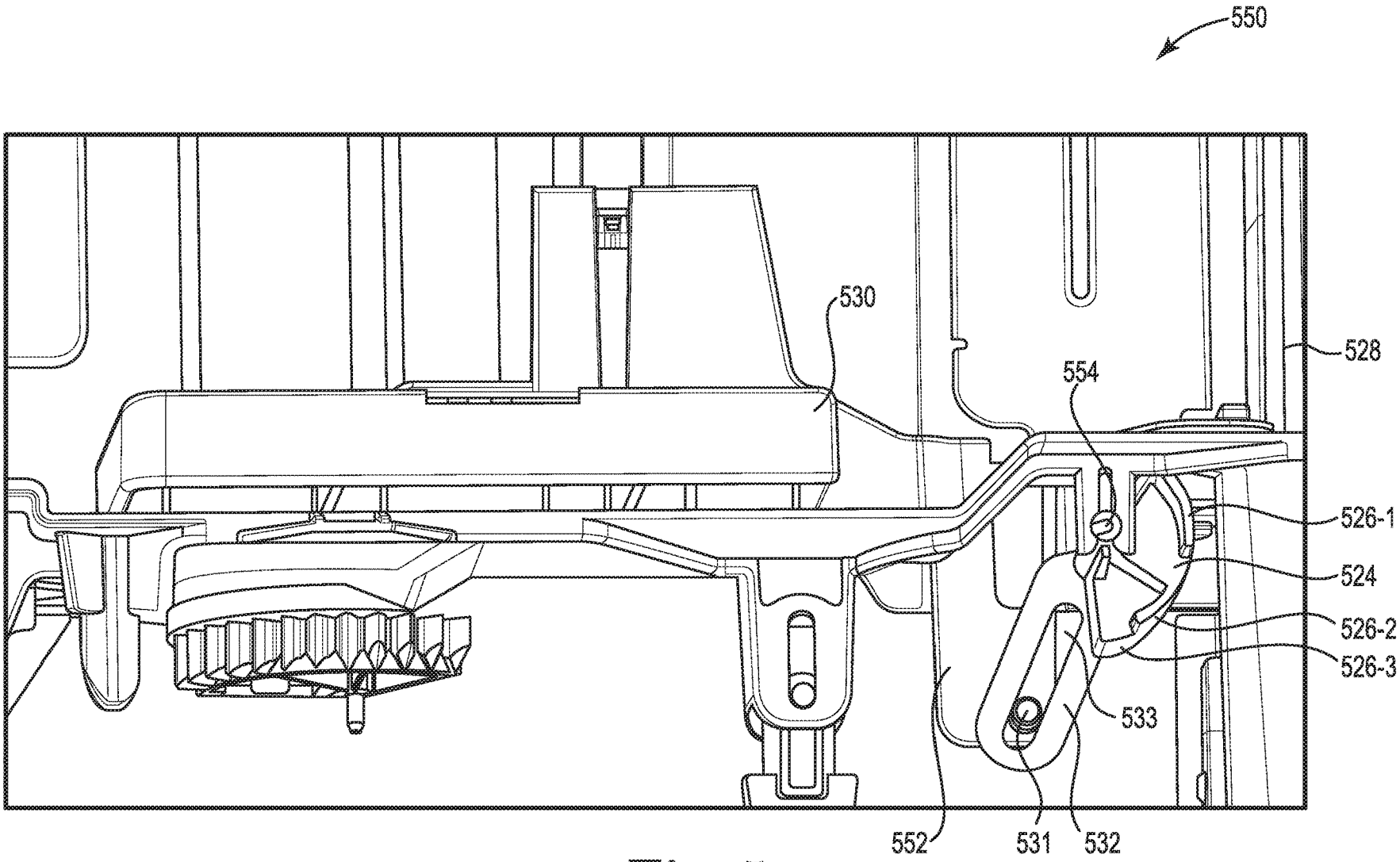
FIG. 5 illustrates an example system for a media size detector consistent with the present disclosure.

FIG. 5 illustrates an example system 550 for a media size detector consistent with the present disclosure. The system 550 can illustrate a top view of a media tray 528 with a media size adjuster 530. As described herein, the media tray 528 can be utilized to store print media for a printing device. In some examples, a printing device can retrieve the print media from the media tray 528.

The media tray 528 can include a media size adjuster 530 to adjust to a plurality of differently sized print media. In some examples, the media size adjuster 530 can include a coupling link 552 that can be coupled to a slotted connector 532 of a size detect barrel 524. The coupling link 552 can be coupled to the slotted connector 532 by a post connector 531 coupled to the coupling link 552, The post connector 531 can move within a slot 533 of the slotted connector 532. For example, the media size adjuster 530 can be adjusted to a size of print media within the media tray 528. In this example, the media size adjuster 530 can be moved in an upward direction as illustrated in FIG. 5. In this example, the coupling link 552 can also move with the media size adjuster 530 and the post connector 531 can move the slotted connector 532 to rotate the size detect barrel 524 on a pivot point 554.

As described herein, when the media size adjuster 530 is adjusted to differently sized media, the size detect barrel 524 can rotate to change a position of a plurality of barrel surfaces 526-1, 526-2, 526-3 that can interact with a plurality of corresponding buttons as described herein. As described herein, the media size adjuster 530 can be adjusted when the media tray 528 is removed or pulled away from a printer chassis 556. In some examples, a device for a media size detector (e.g., device 100 as referenced in FIG. 1, device 200 as referenced in FIG. 2, device 300 as referenced in FIG. 3, device 400 as referenced in FIG. 4, etc.) can be coupled to the printer chassis 556. In some examples, the device coupled to the printer chassis 556 may not move with the media tray 528 and interact with the size detect barrel 524 when the media tray 528 is locked in a closed position as illustrated in FIG. 5.

The above specification, examples and data provide a description of the method and applications, and use of the system and method of the present disclosure. Since many examples can be made without departing from the spirit and scope of the system and method of the present disclosure, this specification merely sets forth some of the many possible example configurations and implementations.

What is claimed:

1. A media size detector, comprising:

a button coupled to a spring of a housing to interact with a media size adjuster of a media tray;

a size detect barrel, positioned between the button and the media tray, coupled to the media size adjuster to rotate based on a position of the media size adjuster, wherein the size detect barrel includes a barrel surface to interact with the button from a plurality of barrel surfaces that protrude from the size detect barrel;

a first side of a lever to receive pressure from the spring when the button is depressed by the media size adjuster; and a second side of the lever to apply pressure to activate or deactivate a switch coupled to a printed circuit assembly when the first side of the lever receives pressure from the spring.

2. The media size detector of claim 1, wherein a signal is sent by the printed circuit assembly to a computing device of a printing device based on whether the switch is activated or deactivated.

3. The media size detector of claim 1, wherein the size detect barrel is positioned between a top portion and a bottom portion of the media tray.

4. The media size detector of claim 1, wherein the first side of the lever is on a first side of the printed circuit assembly and the switch is on a second side of the printed circuit assembly.

5. The media size detector of claim 1, wherein the button interacts with the media size adjuster in a first direction and the second side of the lever applies pressure to the switch in a second direction that is perpendicular to the first direction.

6. A system for media size detection, comprising:

a media size adjuster coupled within a media tray to rotate a size detect barrel based on a selected size of print media;

a media size detector coupled to a rail of the media tray to interact with the size detect barrel, wherein the size detect barrel depresses a combination of buttons of the media size detector based on an orientation of the size detect barrel; and a printed circuit assembly to generate a signal based on the combination of buttons depressed by the size detect barrel, wherein the size detect barrel is positioned between the buttons of the media size detector and the media tray and wherein the size detect barrel includes barrel surfaces to depress the combination of buttons based on a rotation of the size detect barrel.

7. The system of claim 6, wherein the signal corresponds to a particular media size selected by the media size adjuster.

8. The system of claim 7, wherein the particular media size within the media tray is determined based on the generated signal.

9. The system of claim 6, wherein the size detect barrel is coupled to the media tray and rotates the orientation based on adjustments of the media size adjuster.

10. The system of claim 6, wherein the size detect barrel interacts with a plurality of buttons when the media tray is in a closed position.

11. A system for media size detector, comprising:

a plurality of buttons coupled to a first side of a printed circuit assembly to interact with a plurality of barrel surfaces based on an orientation of a size detect barrel positioned between the plurality of buttons of the media size detector and a media tray, wherein a portion of the plurality of barrel surfaces depress a corresponding portion of the plurality of buttons based on the orientation; and a plurality of levers to receive pressure from the corresponding portion of the plurality of buttons on a first side and interact with a corresponding switch coupled to a second side of the printed circuit assembly with a second side.

12. The system of claim 11, wherein the plurality of buttons are coupled to a corresponding plunger to interact with a spring positioned within a housing.

13. The system of claim 12, wherein the plurality of buttons extend outside the housing and the plunger is positioned inside the housing.

14. The system of claim 12, wherein the housing is coupled to a rail of a media tray utilizing the media size adjuster and the size detect barrel is coupled to the media tray.

15. The system of claim 11, wherein the printed circuit assembly alters a voltage based on the corresponding portion of the plurality of buttons depressed by the barrel surfaces of the size detect barrel.

* * * * *